United States Patent [19]

Rye

[11] 4,026,567

[45] May 31, 1977

[54] UPHOLSTERED SEATING SYSTEM

[76] Inventor: Ralph K. Rye, P. O. Box 157, Hope, N.J. 07844

[22] Filed: Sept. 1, 1971

[21] Appl. No.: 176,880

[52] U.S. Cl. ..... 297/445; 297/422; 297/449; 297/456

[51] Int. Cl.[2] ..... A47C 7/00; A47C 7/14

[58] Field of Search ..... 297/220–221, 297/222, 440, 456, DIG. 2, 420–422

[56] References Cited

UNITED STATES PATENTS

| | | | |
|---|---|---|---|
| 2,466,204 | 4/1949 | Brown | 297/440 UX |
| 2,560,969 | 7/1951 | Marshall | 297/455 X |
| 2,699,202 | 1/1955 | Leary et al. | 297/440 UX |
| 2,709,484 | 5/1955 | Lamb | 297/420 |
| 2,829,707 | 4/1958 | Liebson | 297/440 UX |
| 3,154,345 | 10/1964 | Lambrecht | 297/445 X |
| 3,183,036 | 5/1965 | Hill | 297/421 UX |
| 3,336,078 | 8/1967 | Haley | 297/445 UX |
| 3,517,963 | 6/1970 | Woods et al. | 297/456 X |
| 3,600,036 | 8/1971 | Iskander | 299/445 |

*Primary Examiner*—Casmir A. Nunberg
*Attorney, Agent, or Firm*—Richard J. Birch

[57] ABSTRACT

A component system of parts used together and in repetition to make different forms of upholstered seating. The system utilizes three cushion elements which form a seat, a back and an arm which can be used on either right or left side of the seat. The soft foam cushion parts sit on or are attached to molded or shaped platform. The platform is used to locate and attach the metal frame parts which hold the seating system together. In the preferred embodiment, three different platform configurations are used in conjunction with three metal exposed frame parts which are combined in an aesthetic manner with the cushions to form single or multiple seating units.

6 Claims, 43 Drawing Figures

UPHOLSTERED SEATING SYSTEM

BACKGROUND OF THE INVENTION

This invention relates to the design and manufacture of upholstered seating units in general, and more particularly, to a system of parts which when used in combinations and in repetition form single or multiple seating units with or without arms.

In the manufacture of upholstered seating systems, it is important to provide an easy assembly, strength in the various assembled configurations and pleasing appearance while at the same time using only a small number of parts.

It is, accordingly, a general object of the present invention to provide a system of parts which when assembled in various ways form chairs, sofas, or other multiple seating units in various lengths.

It is the specific object of the present invention to provide a unique platform which forms the basis of an arm chair, but when altered by eliminating the area on which the arm is attached, can form a single arm seating unit of either right or left arm, or an armless seating version for a single armless chair, a center section of a sofa or a series of armless seats connected together in a row side-by-side.

It is another object of the present invention to provide a method of assembling an upholstered platform to upholstered cushions and to provide a neat appearance comparable to traditional methods but with less skill, fewer materials, and less time thereby saving manufacturing costs.

It is still another object of the present invention to provide metal or other rigid frame parts which form support internally or inside of the cushion arms and back. The supports are attached to the top of the platform and in turn support the cushions to keep them in place when they are leaned on or sat upon.

It is still a further object of the present invention to provide metal base frame parts which are designed to go with the platforms in their three forms. One part forms an exterior frame to hold the cushion arms in place from the outside and also form the legs. Another part forms an exterior metal arm and leg. Another part forms a metal base inside and under the platforms with four legs. All of the metal base frame parts are attached or secured inside of the platform and pass through channels in the platform so that the parts are recessed and hidden out-of-sight.

It is still another object of the invention to provide a hidden reinforcing bar which allows a number of seats to be placed side by side with legs needed only at the end of the row. The reinforcing bar, in various lengths, attaches to both the platform and the metal base frame parts, thereby allowing the platforms to be used side-by-side and span a distance between legs on multiple seating units.

DETAILED DESCRIPTION OF THE PREFERRED EMBODIMENT

These objects and other objects and features of the invention will best be understood from the following detailed description of the preferred embodiment thereof, selected for purposes of illustration, and shown in the accompanying drawings in which.

Figure 1:
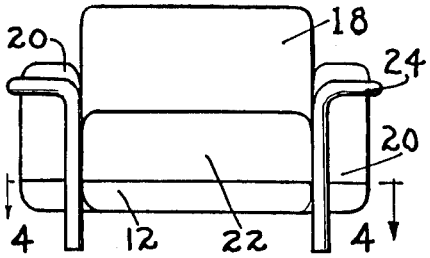
FIG. 1 is a view in front elevation of a cushion arm chair constructed in accordance with the present invention and having a metal outside frame.
Figure 2:
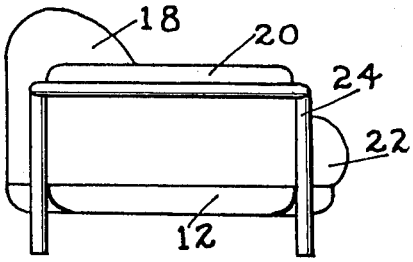
FIG. 2 is a view in side elevation of the cushion arm chair of FIG. 1.
Figure 9:
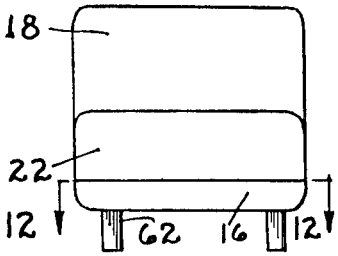
FIG. 9 is a view in front elevation of a third embodiment of the invention showing an armless chair with a metal inside under frame.
Figure 4:
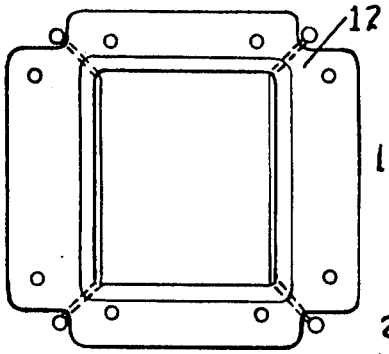
FIG. 4 is a plan view in cross-section taken along line 4—4 in FIG. 1 showing the configuration of the chair platform and the position of the chair legs with respect to the platform.
Figure 3:
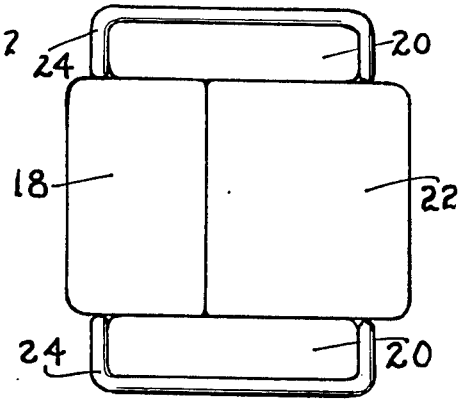
FIG. 3 is a plan view of the cushion arm chair of FIG. 1.
Figure 10:
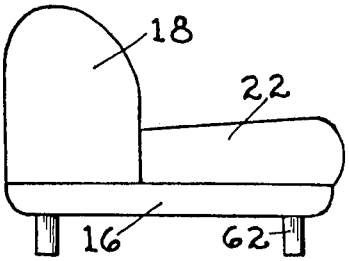
FIG. 10 is a view in side elevation of the armless chair of FIG. 9.
Figure 11:
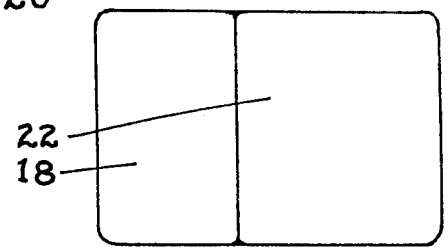
FIG. 11 is a plan view of the armless chair of FIG. 9.
Figure 5:
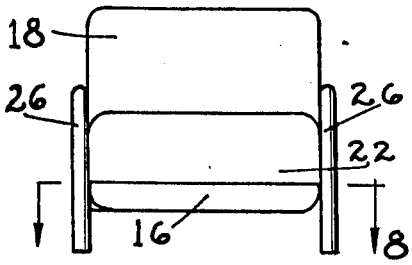
FIG. 5 is a view in front elevation of another embodiment of the invention showing a metal arm chair having a metal outside frame.
Figure 6:
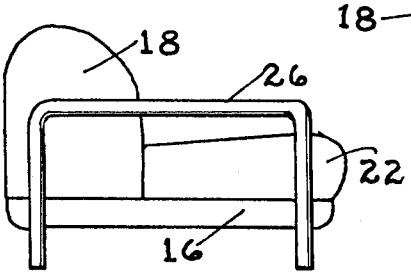
FIG. 6 is a view in side elevation of the metal arm chair of FIG. 5.
Figure 12:
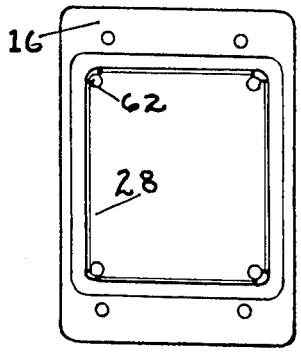
FIG. 12 is a plan view in cross-section taken along line 12—12 in FIG. 9 showing the configuration of the platform and the position of the chair legs in relation to the platform.
Figure 8:
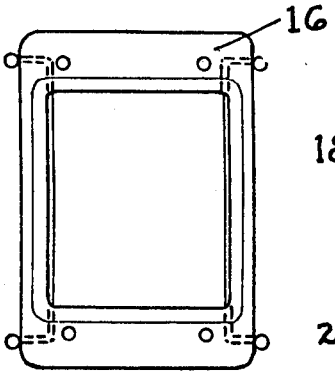
FIG. 8 is a plan view in cross-section taken along line 8—8 in FIG. 5 showing the configuration of the chair platform and the position of the chair legs in relation to the platform.
Figure 7:
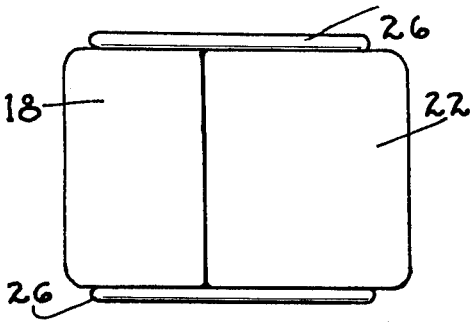
FIG. 7 is a plan view of the metal arm of FIG. 5.
Figure 13:
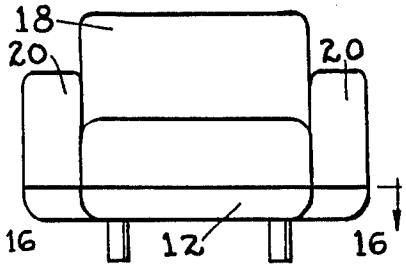
FIG. 13 is a view in front elevation of a cushion arm chair with metal inside under frame.
Figure 14:
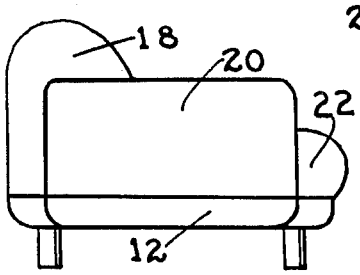
FIG. 14 is a view in side elevation of the cushion arm chair of FIG. 13.
Figure 15:
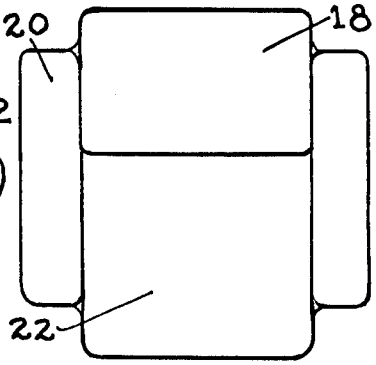
FIG. 15 is a plan view of the cushion arm chair of FIG. 13.
Figure 16:
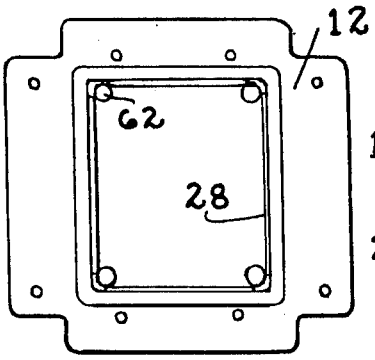
FIG. 16 is a plan view in cross-section taken along line 16—16 in FIG. 13 showing the configuration of the platform and the position of the inside metal under frame in relation to the platform.
Figure 18:
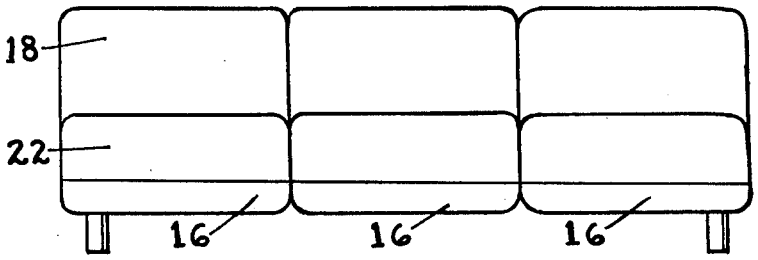
FIG. 18 is a view in front elevation of an armless sofa using platforms without arm extensions situated on an inside under frame with reinforcing bars.
Figure 17:
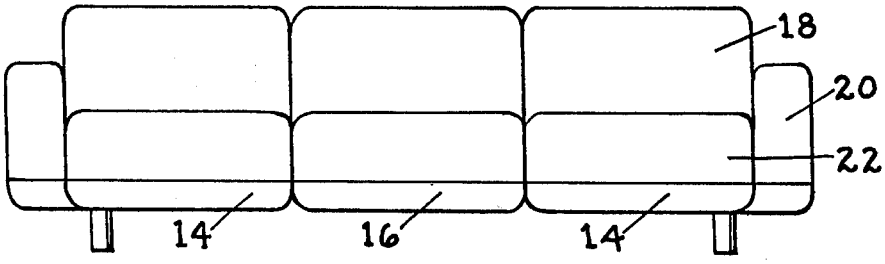
FIG. 17 is a view in front elevation of a cushion arm sofa using platforms with right arm, left arm and armless sections situated on an inside under frame with reinforcing bar.
Figure 19:
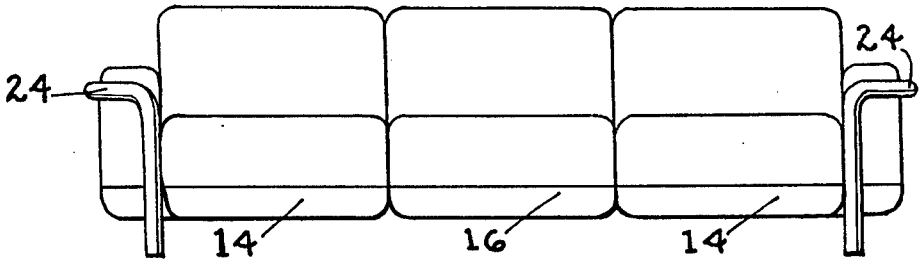
FIG. 19 is a view in front elevation of cushion arm sofa using platforms with right arm, left arm and armless sections situated on metal outside cushion frames with reinforcing bars.
Figure 20:
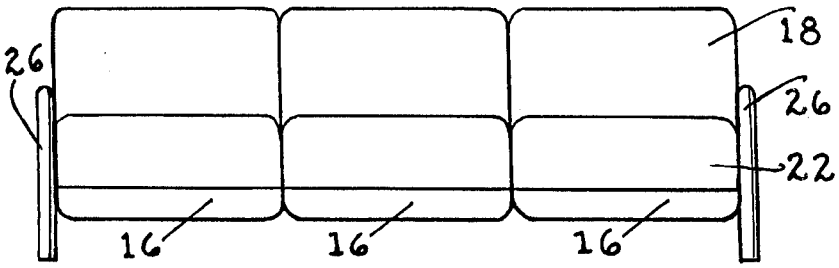
FIG. 20 is a view in front elevation of a metal arm sofa using platforms without arm extensions situated on metal arm frames with reinforcing bars.
Figure 21:
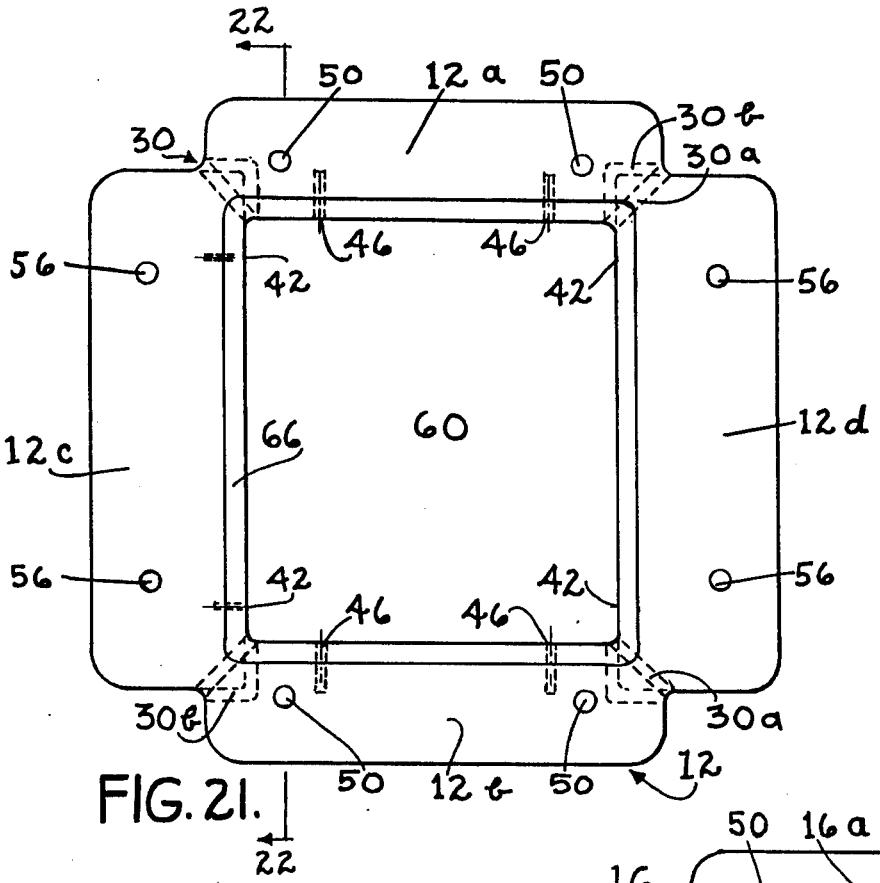
FIG. 21 is a view in plan showing the full or largest platform unit with extensions to support cushion arms, holes for cushion support bars, bolt points to secure metal frames, recessed channels to receive metal frames and an opening for an elastic cushion support.
Figure 22:
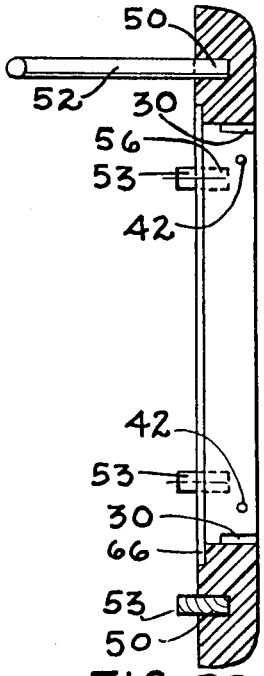
FIG. 22 is a view in cross-section taken along line 22—22 in FIG. 21 showing a back support bar and arm plugs in place and bolt points for securing the metal frames to the platform.
Figure 23:
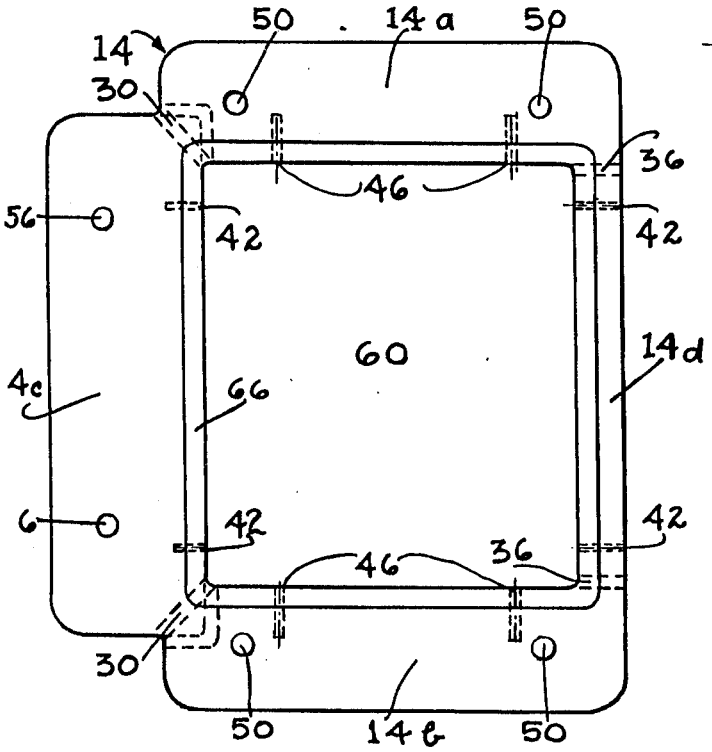
FIG. 23 is a view in plan showing the platform with one side extension to support a cushion arm.
Figure 24:
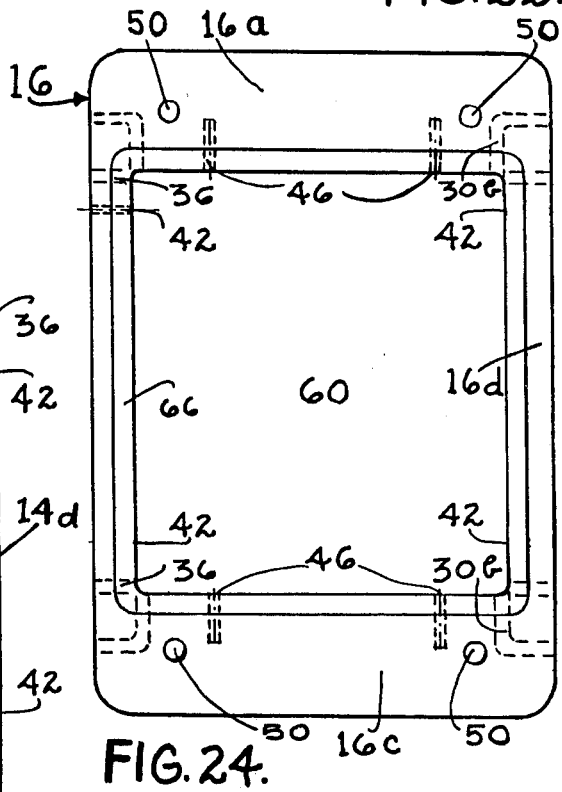
FIG. 24 is a view in plan showing the platform with outside extensions to support cushion arms for making metal arm chairs, armless chairs, center sofa sections and metal arm or armless multiple seating units.
Figure 25:
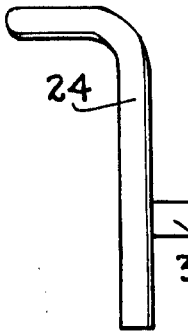
FIG. 25 is a view in front elevation of a metal outside cushion arm frame to hold a cushion arm in position externally.
Figure 27:
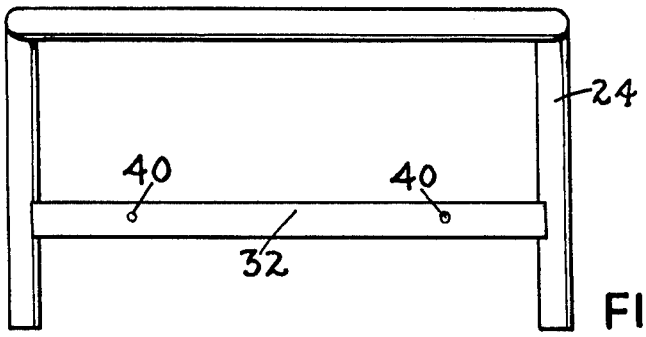
FIG. 27 is a view in side elevation of the metal outside cushion arm frame of FIG. 25.
Figure 26:
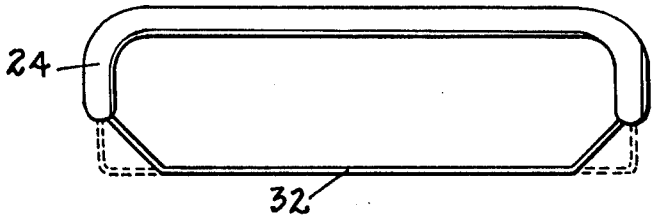
FIG. 26 is a view in plan of the metal outside cushion arm frame of FIG. 25.
Figure 28:
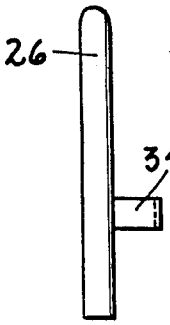
FIG. 28 is a view in front elevation of a metal outside arm frame used for an arm on seating units without cushion arms.
Figure 30:
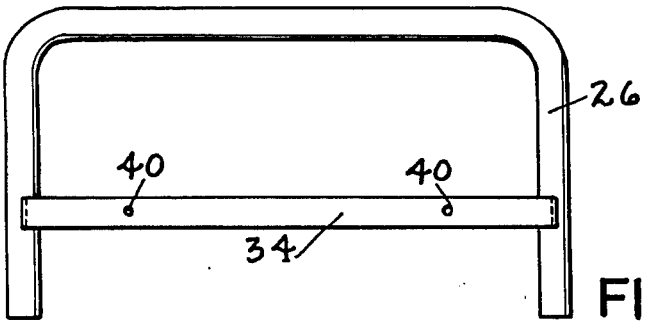
FIG. 30 is a view in side elevation of the metal outside arm frame of FIG. 28.
Figure 29:
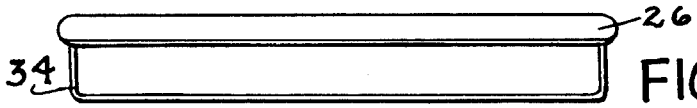

Turning now to the drawings, there is shown in FIGS. 1 through 20 a seating system which is constructed around a basic building element or platform which is illustrated in detail in FIGS. 21 through 24 and identified generally by the reference numeral 10. The platform 10 is produced in three configurations to accept various parts and is also placed in a variety of positions to form many different types of upholstered seating units by using different combinations of parts. The three platform configurations are shown in FIGS. 21, 23, and 24 and are identified by the reference numerals 12, 14, and 16, respectively.

These three platforms, when assembled as shown in FIGS. 1 through 20, support a back rest member 18, one or more arm cushion members 20 and a seat cushion 22. The platforms are supported at proper heights by three corresponding frames: an outside cushion arm frame member 24 (FIGS. 1–3); an outside arm frame member 26 (FIGS. 5–7); and, an inside under frame member 28 (FIGS. 9–12). Specific details concerning the assembly of the various component parts will be described below after first discussing the construction and configuration of the platforms 12, 14, and 16 and the frames 24, 26, and 28.

The seating platforms, shown in detail in FIGS. 21, 22 and 24, can be constructed from a variety of materials and by numerous methods. For instance, each of the platform configurations can be formed from a molded rigid material or machine shaped from wood or other rigid material. The platform 12 depicted in FIG. 21, comprises the basic platform shape for the seating units and is modified into two other related shapes 14 and 16 (FIGS. 23 and 24), both of which have the same inside dimensions and center portion as platform 12.

Figure 35:
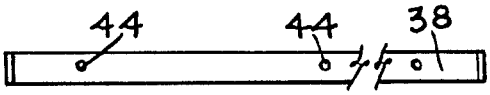
FIG. 35 is a view in front elevation of a typical reinforcing bar which is inserted under the platforms through recessed grooves therein to support a series of side-by-side seating units.
Figure 36:
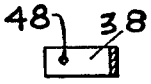
FIG. 36 is a view in side elevation of the reinforcing bars showing holes for connection to the platforms.
Figure 37:
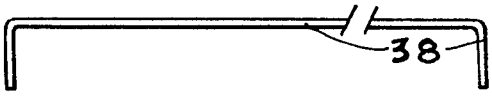
FIG. 37 is a view in plan of the reinforcing bars of FIG. 35.

Looking at FIGS. 21, 23, and 24 it can be seen that the platforms 12, 14 and 16 each have a plurality of recessed grooves 30 which can be either in a straight but angular position 30*a* or with an alternate 90 degree bend in the groove 30*b*. The grooves 30 receive the exterior mounted frames 24 and 26 with the bracket portions 32 and 34 thereof (FIGS. 25–30) passing through the grooves. The platforms 14, 16 as shown in FIGS. 23 and 24 each have recessed grooves 36 which receive a reinforcing bar 38 (FIGS 35–37) in its various length according to the number of seating units which are assembled in side-by-side relation. The grooves which receive brackets 32 and 34 locate the brackets in such a way as to align bracket holes 40 with corresponding holes 42 in each of the platforms 12, 14 and 16. Suitable conventional fasteners (not shown) hold the platforms and frames securely together. The specific locations and/or number of holes in all cases may be varied to suit strength requirements.

The grooves 36 in platforms 14 and 16 receive the reinforcing bar 38 which has a plurality of fastener holes 44. The holes in the reinforcing bar 38 align with corresponding holes 46 in the platforms. Again, suitable conventional fasteners (not shown) are employed to secure the two components together. In order to assure more strength, the bar 38 is bent at right angles at each end with holes 48 designed to align with fastener holes 42 in each of the platform configurations, as well as with the holes 40 in brackets 32 and 34 of frames 24 and 26.

Figure 33:
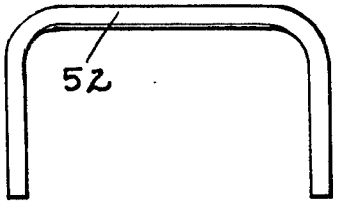
FIG. 33 is a view in elevation of a back or arm cushion support bar which is inserted into holes molded into the platform and which fits into a pocket molded into the soft foam upholstered cushions.
Figure 34:
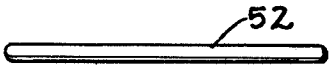
FIG. 34 is a view in plan of the back or arm cushion support bar of FIG. 33.
Figure 44:
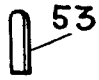
Figure 39:
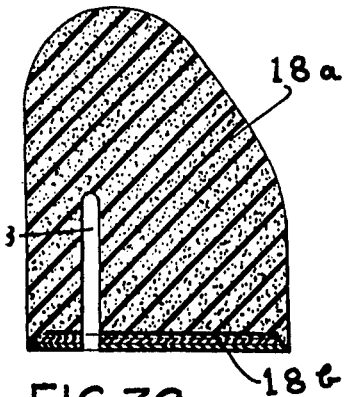
FIG. 39 is a view in cross-section of the upholstered back cushion taken along line 39–39 in FIG. 38.
Figure 38:
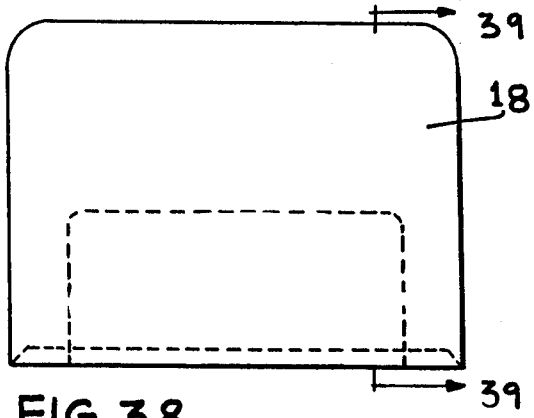
FIG. 38 is a view in front elevation of an upholstered back cushion showing the position of a pocket for insertion of the support bar and a nailable base for attachment of the upholstery material.
Figure 41:
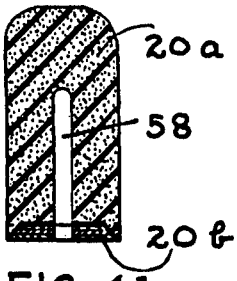
FIG. 41 is a view in cross-section of the upholstered cushion arm taken along line 44—41 in FIG. 40.
Figure 40:
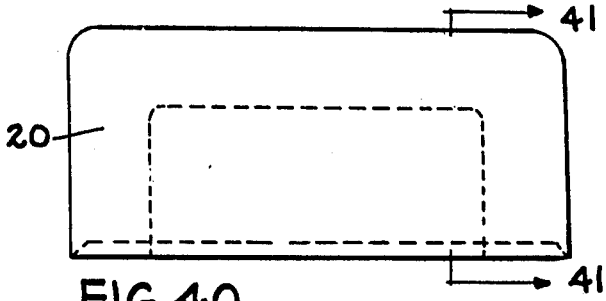
FIG. 40 is a view in side elevation of an upholstered cushion arm showing the position of a pocket for the support bar and a nailable base for attachment of the upholstery material.
Figure 43:
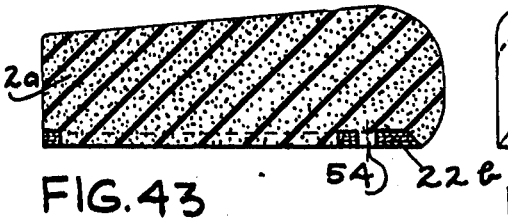
FIG. 43 is a view in cross-section of the upholstered cushion seat taken along line 43—43 in FIG. 42.
Figure 42:
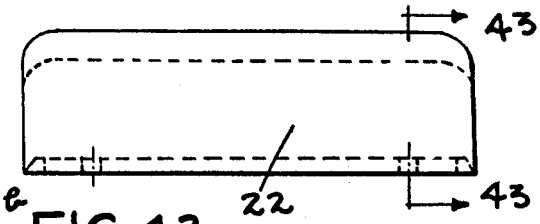
FIG. 42 is a view in front elevation of an upholstered cushion seat showing the position of the holes in the nailable base to allow the cushion to stretch during use.

Fastener apertures 50 are provided in all three platform configurations at the front and rear to accommodate a back support bar 52 as shown in FIGS. 33 and 34. When the back support bar is inserted at one end of the platform, the opposite end is plugged with a dowel 53 (FIG. 38) which extends above the platform surface as shown in section FIG. 22. The extended dowel fits into a corresponding hole 54 in the rigid base of the seat cushion 22 shown in FIG. 43. This friction fit keeps the cushion from sliding out of place, although other means of securing can be used instead of, or in addition to dowel 53. Similar holes 56 are provided on the sides of platforms 12 and 14 to accommodate the side arm support bar 52 as shown in FIGS. 33.

For the seating designs shown in FIGS. 13 through 17, the side arm support bar 52 is used to support the cushion arm 20 internally by slipping the bar 52 into a molded groove 58 in the foamed arm and rigid base portions 20*a* and 20*b*, respectively. This support bar is secured to the platform by suitable fasteners (not shown). In the seating units shown in FIGS. 1 through 4 and FIG. 19, the internal arm support bars are not employed because of the outside support frame 24. However, plugs 53 are inserted into holes 56 to locate the base of the arm cushion 20 and keep it from sliding out at the bottom when the seat cushion 22 is sat upon and squeezes out at the sides thereby forcing the base of the arm cushion 20 outwardly.

Figure 31:
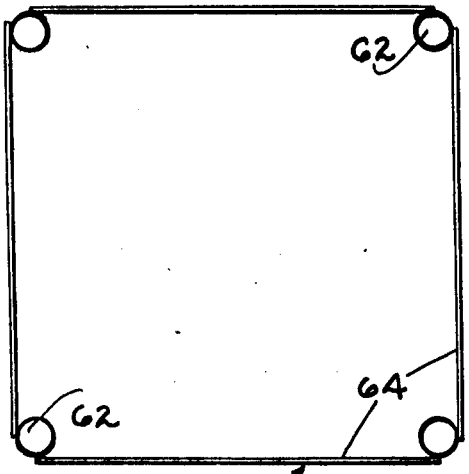
FIG. 31 is a view in plan of a metal inside under frame which fits into an opening in the platform provided for an elastic seat support.
Figure 32:
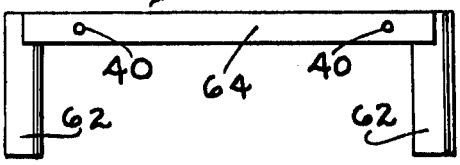
FIG. 32 is a view in side elevation of the metal inside under frame of FIG. 31.

An inside underframe 28 shown in FIG. 31 and 32 fits into the open area 60 in the middle of the platforms 12, 14, and 16. In a single chair, the inside underframe 28 and the frame holes 40 align with the platform holes 42 and 46 and the frame is securely fastened with appropriate fasteners (not shown). In multiple seating groups, the under frame is extended so that the frame legs 62 are at the outer ends of the sofa unit depicted in FIGS. 17 and 18 and the continuous bar portion 64 extends through the grooves in all of the platforms thereby performing the same function as the reinforcing bar 38.

It is important to recognize the mechanical way in which all of the parts work together to give a maximum variety of chair or sofa seating units with as few parts as possible. The method of assembly replaces traditional forms of upholstery. The cushions are slip-covered over the top and fastened under the bottom to the hard base portions 18*b*, 20*b*, and 22*b*. The platforms are covered by either fitting the fabric to the outside and tacking on the top and bottom or by glueing the fabric to the visible surfaces.

Referring to FIGS. 21 through 24, each platform has a perimeter recess 66 around the top of the open center portion. This recess receives a suitable elastic material (not shown) which supports the seat cushion 22 and allows the cushion to stretch and compress for maximum comfort when sat upon. It is desirable to recess the edges of the elastic material so that the seat cushion will sit flush against the top face of the platform.

When the cushions are positioned on the platforms, all of of the tacking and fabric edges are concealed leaving a neat butting of two upholstered square edges. The ease of assembly requires little skill since all parts are designed to to fit together when placed in their designed location. The system is designed for maximum neat appearance with all structural connections hidden from view.

It will be appreciated that the platforms 12, 14, and 16 are the basic part on which the entire seating system is built. The largest platform 12 is designed specifically for a single chair and is symmetrical front-to-rear with end portions 12*a* and 12*b* and side-to-side with side portions 12*c* and 12*d*. Preferably, the platform is formed from a molded plastic, but it can also be shaped of any rigid material. Since the platform is symmetrical, the front edge of the seat cushions 22 extends the same distance beyond the front edge of the arm 20 as the back cushion 18 extends beyond the rear edge of the arm.

The largest platform 12 is designed to receive the outside cushion arm frame 24 on both sides since the arm frame itself is also symmetrical. The arm frame 24 preferably is formed from metal and has two legs in a continuous frame with two double reverse bends. The arm frame bends enclose the cushion arms on three sides and conform to the shape of the cushion sides, and corners. The frame legs nestle into the corner of the platform. The position of the legs hides the front corners where the seat cushion 22 and the arm cushion 20 meet, and the rear corners of the back cushion 18 meet the arm cushion 20. No connection to any metal parts or the platforms are visible due to the hidden method of connecting through the recessed grooves 30*a* or 30*b* which ever is used.

The design of the largest platform 12 also allows the inside underframe 28 to be installed under the seat with four short legs 62 showing under the platform and secured by the same means and holes as received by the metal outside cushion arm frame 24. In this case, the cushion arms 20 are internally supported by the same sized bar 52 which supports the back cushion 18 since the bars are interchangeable. The back cushion has a similar groove 68 to accommodate the bar 52.

Using a molding process to make the platform 12, it is easy and economical to block out one portion of the mold to form the platform 14 which will accommodate either outside cushion arm frame 24 on one side or the inside underframe 28 and can be assembled into double or multiple seating units. The single arm platform 14 is identical from front-to-back and, therefore, can be reversed to form a right arm unit or left arm unit with no change in molds and using the mold for the large platform 12, thereby further reducing mold costs.

Continuing to use the basic mold for the largest platform 12 and blocking out both sides where the arm cushions attach, the platform configuration illustrated in FIG. 24 is obtained. The smaller platform 16 is used as a center section of a sofa, a single seat without arms, a single seat with arms 26 or a series of seats or sofa with arms or without. It also holds true that the small platform 16 and the other platforms can be machine shaped at an economical cost.

The smallest platform 16 is designed to receive arm frame 26 to form a single chair with arms or a series of seats in a line with metal arms. The arm frame 26 has hidden connections through the recesses in the platform and, like the outside cushion arm frame 24, has no visible connection. The arms, of course, can be adjusted to any desirable height according to the need of the seating unit.

The smallest platform 16 also receives the inside underframe 28 which is used for a single armless seat or if extended in length can accommodate and hold together a plurality of seats in a line side-by-side.

All of the legs are designed so that the seating height is easily changed without changing the shape of any other part, only the length of the leg. There are only nine basic parts to the seating system which make up many different seating arrangements and appearances for varied uses. These parts comprise the back, seat and arm cushions, 18, 20, and 22, the three platforms, 12, 14, and 16, the two arm frames 24 and 26, and the underframe 28. The remaining components are standard items such as bolts, screws, and/or tacks.

What I claim and desire to secure by Letters Patent of the United States is:

1. A seating unit comprising:

a generally rectangular, planar rigid platform having two side portions and two end portions, said side and end portions collectively defining a generally rectangular interior opening in said platform;

at least one arm frame means having an outwardly extending bracket;

means defining a plurality of grooves in said platform adapted to receive the outwardly extending bracket of at least one of said arm frame means;

means for securing said arm frame bracket to said platform;

a back cushion;

means for supporting said back cushion on said platform; and, a seat cushion positioned in superposed relation on said platform.

2. The seating unit of claim 1 wherein said arm frame means bracket is secured to the interior edge of one of said side portions.

3. The seating unit of claim 1 wherein said unit includes at least one arm cushion, said arm cushion being supported by said arm frame means.

4. The seating unit of claim 1 wherein said platform is generally symmetrical front-to-back about an axis extending through said side portions.

5. The seating unit of claim 4 wherein said platform is generally symmetrical side-to-side about an axis extending through said end portions.

6. The seating unit of claim 1 wherein one of said side portions is relatively narrow with respect to the other side portion.

* * * * *